United States Patent [19]

Künzel et al.

[11] 4,183,981

[45] Jan. 15, 1980

[54] LAUNDRY FINISHING TREATMENT ROPE AND METHOD

[75] Inventors: Werner Künzel, Langenfeld; Karl Schwadtke, Leverkusen; Alexander Cioc, Dusseldorf; Michael Kik, Langenfeld; Rolf Puchta, Haan, all of Fed. Rep. of Germany

[73] Assignee: Henkel Kommanditgesellschaft auf Aktien, Dusseldorf-Holthausen, Fed. Rep. of Germany

[21] Appl. No.: 864,537

[22] Filed: Dec. 27, 1977

[30] Foreign Application Priority Data

Dec. 27, 1976 [DE] Fed. Rep. of Germany ..... 2659018

[51] Int. Cl.[2] ..... B05D 3/12; D06M 11/00

[52] U.S. Cl. ..... 427/242; 34/9; 34/12; 34/60; 57/258; 57/901; 428/396

[58] Field of Search ..... 427/242; 34/60, 9, 12; 57/153, 149, 157 AS, 164, 258, 901, 295; 87/1; 252/8.8; 424/27, 28, 18; 428/396

[56] References Cited

U.S. PATENT DOCUMENTS

| | | | |
|---|---|---|---|
| 1,803,869 | 5/1931 | Ruff | 57/153 X |
| 3,311,625 | 3/1967 | Wakeman et al. | 424/27 X |
| 3,646,846 | 3/1972 | Houghton et al. | 57/153 X |
| 3,843,395 | 10/1974 | Morton | 427/242 |
| 4,012,326 | 3/1977 | Rudy et al. | 427/242 X |

FOREIGN PATENT DOCUMENTS

| | | | |
|---|---|---|---|
| 907215 | 10/1962 | United Kingdom | 57/153 |

*Primary Examiner*—Evan K. Lawrence

*Attorney, Agent, or Firm*—Hammond & Littell

[57] ABSTRACT

A laundry finishing treatment rope for use in a mechanical laundry drier comprising an entwined strand of textile fibers in a cord form having both ends secured against fraying, the rope being impregnated with 10% to 90% by weight of a substance of the laundry finishing treatment type effective in a mechanical laundry drier; as well as the method of finishing laundry by tumble drying the laundry in the presence of the rope in a mechanical laundry drier.

19 Claims, 4 Drawing Figures

LAUNDRY FINISHING TREATMENT ROPE AND METHOD

BACKGROUND OF THE INVENTION

The present invention relates to a laundry finishing article and the process of using the article to finish laundry in a mechanical drier.

During the washing process of laundry in mechanical washing machines the laundry is first washed with water containing detergent and then drained and rinsed one or several times with rinse water. This rinse treatment is usually of a short duration. During this rinsing treatment use is frequently made, particularly in the last rinse step, of agents which are intended to impart improved properties to the washed laundry, such as a soft and fleecy feel, antistatic behavior, an antimicrobe protection and a pleasant smell. In order to be suitable for these finishing treatment methods, these agents must not only become uniformly distributed in the cold rinsing bath, but also become exhausted in a short time from the bath onto the textiles. Useful products are indeed on the market, which impart to the laundry in the last rinsing bath the desired, predominantly softening and antistatic properties, but all the items of laundry are uniformly affected by this type of treatment, so that the laundry must be sorted out already before washing with a view toward the finishing treatment. Moreover, care must be taken with this method that the finishing treatment agent is introduced into the washing machine at the correct time or through a special metering device and without coming into contact with the actual washing agent.

A further disadvantage of the known laundry finishing treatment agents is that they can be made up only as highly diluted, aqueous suspensions, since stability during storage, ease of pouring and rapid distribution in the cold rinsing water is assured only when the effective substances are present in a dilution of 10 to 20 times, which leads to relatively high costs for packaging and transportation. Substances which are insoluble in cold water are just as poorly suited for this kind of laundry treatment as those which possess no specific affinity for the textile fiber surface, both are poorly exhausted from the rinse water and, consequently, with the used rinsing water, are passed to the sewer system. Therefore, the number of usable-effective substances is limited.

With the steadily increasing use of laundry drying machines in industrial laundries and in private households, because of the saving in space and time in laundry drying afforded by such use by comparison with hanging the laundry on a line to dry, new possibilities now arise for moving the process of laundry finishing treatment to the drier itself and carrying it out simultaneously with the drying of the laundry. Recently, a series of proposals have, therefore, been made as to how known and new effective substances can be applied to the finishing treatment of laundry in the laundry drier. Among these proposals are the use of textile or paper webs which are impregnated with the effective substance, as described in U.S. Pat. Nos. 3,632,396, 3,686,025 and 3,743,534, and the use of foaming or non-foaming aerosol mixtures, with which the effective substances are sprayed onto the internal wall of the drier or onto the moist textile articles.

Furthermore, the use of perforated hollow objects, which contain a solution of the effective substance and which are tumbled in the laundry drier together with the laundry, as described in U.S. Pat. No. 4,014,105, and of solid, pelletized mixtures of the effective substances with soluble carrier substances, which are to be absorbed during the drying process onto the textile surface, has also been discussed. These forms of application of the state of the art are, however, accompanied by a series of disadvantages. Thus, for example, a non-uniform distribution and a consequent forming of stains on the laundry are observed in the use of solid textile softeners. Even with the perforated hollow articles filled with liquid finishing treatment agents, the problem of the uniform distribution of the effective substances is not solved, added to which are the further disadvantages of the cumbersomeness of these articles and the difficulty of metering the effective substances. With the use of the agent in spray form, undesired precipitations frequently form on the equipment parts important for correct functioning of the laundry drier equipment, such as, for example, the temperature and humidity sensors. With the sheets of paper, woven or non-woven fabric impregnated with the effective substance, it is to be observed that the effective substance adhering to the substrate, which should become detached from the substrate and adsorbed onto the textile to be dried, is only incompletely given off due to the fact that these structures, which have a large surface area, tend to cling to the wall of the dryer drum or to a piece of the laundry, which also imposes a limit upon the effectiveness of this form of application.

U.S. Pat. No. 3,701,202 discloses another method of distributing liquid textile treating agents in a drum dryer which comprises a container with a porous outlet which is clamped in the rotatable drum. This likewise creates problems of uneven distribution of the treating agents and involves the additional problem of detaching and replacing the container after each operation or after several operations, in order to fill the same.

Another commercial development of the same nature is the use of a porous container which has a self-adhering side, which is attached to the wall of the dryer drum, as is described in U.S. Pat. No. 4,004,685. This type of device presents the problem of even application of the treating agents to the goods, particularly since the commercial embodiment is designed to be used over a series of drier cycles.

U.S. Pat. No. 3,989,638 likewise is directed to the problem and discloses the use of articles releasably containing starch-thickened peroxygen bleaches for use in machine laundry driers. Patentee employs articles having perforations in the range of 0.05 to about 3 mm in order that his thickened bleaches can be released at the proper rate, since moisture must be present to effect the bleaching action. This device suffers the drawback that the amount of bleach being dispensed at the onset will depend on the temperature of the bleach package storage since the viscosity of the starch thickened bleach is dependent on temperature. Moreover, such an article must be covered until the time of use and care must be taken to avoid loss of bleach from the article before inserting the same into the dryer.

SUMMARY OF THE INVENTION

An object of the present invention is the development of a laundry finishing treatment agent which is suitable for use in a mechanical laundry drier and in the form of a dispensing device charged with effective substances.

Another object of the invention is the development of a laundry finishing treatment rope for use in a mechanical laundry drier comprising an entwined strand of textile fibers in a cord form having both ends secured against fraying, said rope being impregnated with an effective amount of an effective substance of the laundry finishing treatment type.

A further object of the present invention is the development of a process for the use of the above laundry finishing treatment agent when drying moist washed laundry in a mechanical laundry drier.

These and other objects of the invention will become more apparent as the description thereof proceeds.

The article of the present invention is a laundry finishing treatment rope for use in a mechanical laundry drier comprising an entwined strand of textile fibers in a cord form having both ends secured against fraying, said rope being impregnated with an effective amount of a substance of the laundry finishing treatment type effective in a mechanical laundry drier. The effective substance may be a textile softener or antistatic agent optionally accompanied by auxiliary substances and perfumes.

By "textile fiber rope in the form of an entwined cord" or "entwined strand of textile fibers in a cord form", is meant an elongated, fairly loose structure of fibers manufactured by twisting, interlacing, braiding or knitting a plurality of threads of textile fibers, the elongated structures produced in this way preferably having a circular cross-section and forming a continuous solid or hollow rope.

Impregnation is carried out by steeping the rope of textile fibers in a solution, dispersion or solvent-free melt of the active substances and other additives, either separately or as a mixture, and then drying or hardening the coating thus applied.

The method of the invention is an improvement in the process of after-treating laundry in a mechanical drier in the presence of a laundry finishing treatment agent which acts on the laundry and recovering dry after-treated laundry, the improvement consisting of using the laundry finishing treatment rope as the treatment agent.

Due to its compact form and low air resistance, the rope according to the invention, hereinafter referred to as "conditioner cord", makes uniform contact with the moving articles of laundry when used in a drier, so that the impregnated active substances are transferred to the surface of the textile and adsorbed there uniformly, without producing stains. In this process, the active substance adhering to the surface of the fibers in the interior of the cord is given off to the surfaces of the more externally situated fibers which are already depleted of active substance, so that unduly rapid transfer of the active substance to the textiles is avoided.

DESCRIPTION OF THE PREFERRED EMBODIMENTS

Figure 2:
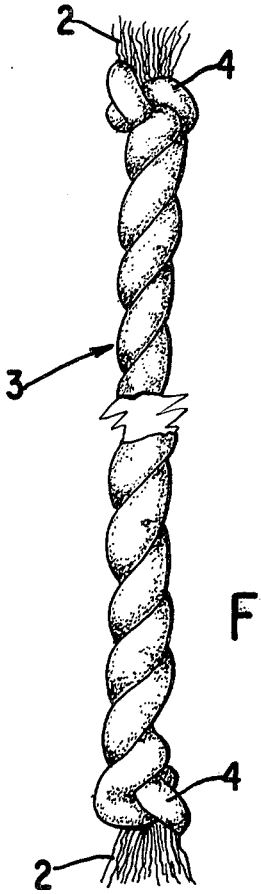
FIG. 2 is a view of another embodiment of the laundry finishing treatment rope of the invention in cabled form with knotted ends.
Figure 3:
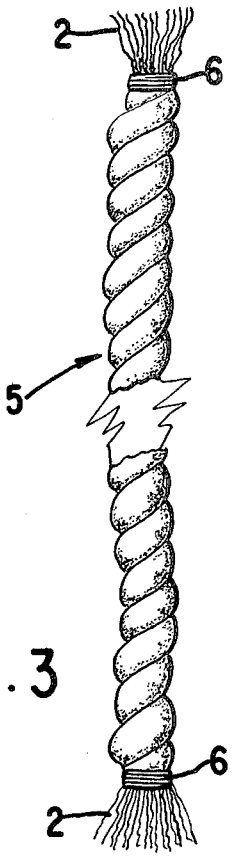
FIG. 3 is a view of another embodiment of the laundry finishing treatment rope of the invention in cabled form with bound ends.
Figure 4:
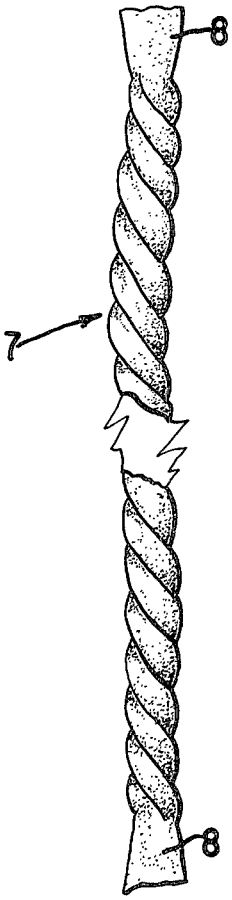
FIG. 4 is a view of another embodiment of the laundry finishing treatment rope of the invention in cabled form with welded ends.

The cords used as carriers may be manufactured by the usual methods of ropemaking. Suitable forms are, for example, braided cables (see FIG. 1), in which the textile fibers in thread form are braided 1 and, as a result of the manufacturing method employed, the ends 2 are prevented from fraying more than a slight amount during the operation in the drier since the threads have been repeatedly plaited. Knitted or warp knitted hollow braids and loosely twisted cables 3, 5 and 7 (see FIGS. 2,3,4) the ends 2 of which are prevented from fraying by a knot 4 (FIG. 2), or by gluing or by a yarn wound around them 6 FIG. 3), or in the case of synthetic fibers, by welding 8 (FIG. 4) are also suitable.

The conditioner cords generally have a diameter of from 0.3 to 3.5 cm, preferably from 0.5 to 1.5 cm, and a length of 10 to 50 cm, preferably 20 to 40 cm. Their weight is, therefore, from 1 to 15 gm, in particular from 3 to 10 gm.

Figure 1:
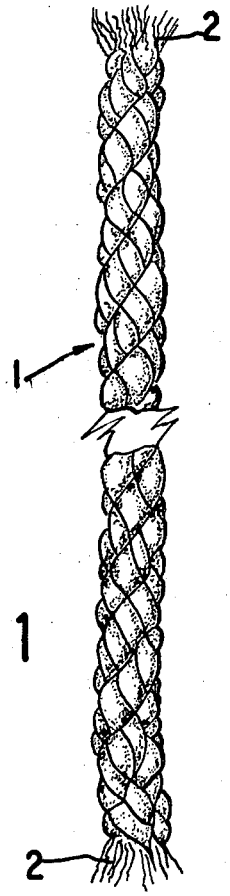
FIG. 1 is a view of an embodiment of the laundry finishing treatment rope of the invention in braided form.

A typical example of the device according to the invention represented in FIG. 1 has a thickness of about 1 cm and a length of about 30 cm and weights 5 gm when impregnated. 2.3 gm of this weight is contributed by the cord as carrier and 2.7 gm by the impregnation of active substance.

The dimensions of the conditioner cord are generally calculated so that the active substances which it is capable of delivering are sufficient for conditioning one loading of a conventional domestic laundry drier, i.e., approximately 2 to 3 kg of dry laundry. More than one conditioner cord may, of course, be used for one conditioning operation if it is desired to obtain very pronounced effects. Repeated use of the cords is also possible if the active substances are not completely used up in one operation, for example, if the drier is not maximally loaded.

For use in standard domestic driers, therefore, the conditioner cords are generally designed to contain from 0.5 to 5 mg of fabric softener or antistatic treatment substance while the weight of the cord which constitutes the carrier is generally from 1 to 5 gm. The quantity of active substance and optionally also auxiliary substances should amount to from 10% to 90% by weight, in particular from 20% to 80% by weight, based on the completed article.

For use in driers of industrial laundries, thicker cords, for example, with a thickness of up to 3.5 cm, and with a length of up to 50 cm, are used to correspond to the greater capacity of the driers which is up to about 50 kg of dry laundry.

The materials used for the conditioner cords may by synthetic textile fibers of polyacrylonitrile, polyester or polyamide or natural fibers of cotton, wool, hemp or flax.

The cords are preferably brightly colored so that they can be distinguished in the loaded drier and easily separated from the dried laundry.

The substances used as fabric softeners and antistatic treatment agents may be any of those already known which are at present used in liquid after-rinse conditioners for the last rinse of machine washing. These are primarily the quaternary ammonium compounds with preferably two long chain aliphatic hydrocarbon groups, which are described in more detail below, and the condensation products of higher fatty acids with polyalkylene polyamines and hydroxyalkyl polyamines. Antimicrobial agents, soil release substances, ironing aids and impregnating, flame-retarding and mothproofing substances may also be used. As a general rule, the substances should melt or soften under the operating conditions of a laundry drier, i.e., at temperatures of between 35° C. and 100° C., preferably at a temperature below 75° C., but active substances melting above 100° C. may also be used, provided that their melting or softening point is lowered by the presence of the other additives or by solvents so that they can become uniformly distributed over the textiles under treatment.

Another advantage of the devices according to the invention is that they also make it possible to use active substances which are difficultly soluble in water or which have no affinity for the fibers and, therefore, cannot be used in conditioners which are applied during rinsing of the laundry.

Suitable textile softeners are quaternary ammonium compounds preferably having two long chains, preferably saturated aliphatic groups each containing from 14 to 26, preferably from 16 to 20 carbon atoms, with at least one quaternary nitrogen atom in the molecule. The long chain aliphatic groups may be straight or branched chain and hence may be derived from fatty acids or fatty amines, Guerbet derived amines, or from alkylamines obtained by the reduction of nitroparaffins. These quaternary ammonium compounds are mainly derivatives of ammonia, i.e., quaternary salts obtained by the alkylation of long chain secondary amines, e.g., the compounds distearyldimethylammonium chloride or ditallow alkyldimethylammonium chloride, or imidazoline compounds which can be obtained by reacting one mol of an aminoalkylethylenediamine or hydroxyalkyl ethylenediamine with 2 mols of a long chain $C_{12-26}$ fatty acid or an ester thereof, and which are subsequently converted into the quaternary imidazolinium compounds by alkylation. In these quaternary ammonium compounds, the anion is generally an acid group obtained from the alkylating agent used for quaternization. The anion may, therefore, be, for example, chloride, bromide, methyl sulfate, ethyl sulfate or methane, ethane or toluene sulfonate.

Preferably employed quaternary ammonium compounds have the formula:

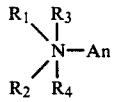

wherein $R_1$ and $R_2$ are selected from the group consisting of alkyl having from 14 to 26 carbon atoms and alkenyl having from 14 to 26 carbon atoms, $R_3$ and $R_4$ are selected from the group consisting of alkyl having 1 to 4 carbon atoms and alkylol having from 2 to 4 carbon atoms and An is an anion selected from the group consisting of halide, lower alkyl sulfate, lower alkyl sulfonate, phenyl sulfonate and lower alkylphenyl sulfonate.

In addition to these quaternary ammonium compounds, the condensation products of 1 to 3 mols of a fatty acid or fatty acid alkyl ester or one third to one mol of fatty acid triglyceride with one mol of a hydroxyalkyl polyamine, for example, hydroxyethyl ethylenediamine or hydroxyethyl diethylenetriamine may be used also as fabric softeners. The product obtained by the reaction of one mol of a fatty acid triglyceride, in particular, hardened tallow, with one mol of hydroxyethyl ethylenediamine at 90° to 150° C. is particularly suitable. The preferred textile softener is a combination of a quaternary ammonium compound of the ammonia series having two $C_{16}$–$C_{20}$ alkyl or alkenyl groups and two methyl groups in the molecule and a chloride, bromide or methyl sulfate anion, in particular ditallow alkyldimethylammonium chloride, with the fatty acid condensation product of one mol of hardened tallow and one mol of hydroxyethyl ethylenediamine, used in proportions of between 4:1 and 1:4. Textiles treated with these combinations show a marked and uniform improvement in their handle without any stain buildup.

The antistatic treatment substances are generally the same or similar types of compounds to those used as fabric softeners. Apart from the quaternary ammonium compounds and fatty acid condensation products described above, quaternary ammonium compounds containing one long chain and three short chain aliphatic groups may also be used as textile antistatic treatment substances. Other suitable antistatic agents are, for example, the reaction products of one mol of an aliphatic $C_6$–$C_{20}$ alcohol and more than 20 mols, preferably 35 to 50 mols, of ethylene oxide.

Suitable antimicrobial treatment substances, i.e., compounds which have a bactericidal or bacteriostatic or fungicidal or fungistatic action, are in most cases also quaternary ammonium compounds, particularly those which, in addition to one long chain aliphatic and two short chain aliphatic hydrocarbon groups contain an aromatic group which is attached to the nitrogen atom through an aliphatic carbon atom, or an aliphatic organic group which contains double bonds. Typical representatives of such antimicrobial active substances are the compounds, dimethyl-benzyldodecylammonium chloride, dibutyl-allyl-dodecylammonium chloride and ethyl-cyclohexyl-allyl-dodecylammonium chloride. Bromonitroalcohols are also suitable antimicrobial substances, for example, the compounds, 2-bromo-2-nitropropane-1,3-diol, 1-bromo-1-nitro-3,3-trichloro-2-propanol and 2-bromo-2-nitrobutanol. Halogenated and/or trifluoromethyl-substituted phenolic compounds are also suitable antimicrobial substances, particularly the halogenated salicylanilides, e.g., the compounds, dibromo-salicylanilide and tribromo-salicylanilide, and derivatives of p-phenoxyphenol, such as the compound, 2-hydroxy-2',4,4'-trichlorodiphenylether.

Suitable active substances for use as soil release finishes for textiles are compounds which allow the dirt to be more easily released from the laundry during the washing process. These include compounds, such as polyacrylpolyvinyl alcohols, modified fluorinated hydrocarbons and hydrophilic polymers. Polyvinyl acetates and borax are suitable additives which make the laundry easier to iron.

The auxiliary substances or additives which may be used according to the invention include in particular dispersing agents, preferably nonionic surface-active agents. Nonionic surface-active agents suitable for use as dispersing agents are primarily the addition products of from 4 to 40, preferably from 4 to 20, mols of ethylene oxide to one mol of an aliphatic $C_{10}$–$C_{20}$ alcohol, preferably an alkanol or alkenol, or of an alkylphenol, a fatty amine or a fatty acid having this chain length. Particularly preferred are the ethoxylation products of the fatty alcohols, in particular of coconut and tallow fatty alcohols and of oleyl alcohol and the ethoxylation products of the oxo alcohols and secondary alcohols having corresponding chain lengths.

Other suitable dispersing agents include the water-soluble addition products, containing from 20 to 250 ethylene glycol ether groups and from 10 to 100 propylene glycol ether groups, obtained by the chemical addition of ethylene oxide to polypropylene glycol or to alkylenediamine polypropylene glycol or to alkylene polypropylene glycols having 1 to 10 carbon atoms, in which the polypropylene glycol chain functions as hydrophobic groups.

In the process for the manufacture of the device for the after-treatment of laundry in the drier, a textile fiber rope in the form of a cord is immersed in a solution, solvent-free melt or dispersion of the active substances and which may also contain auxiliary substances and perfumes and is then left to dry or solidify in a stream of hot or cold air.

Suitable solvents for solutions and dispersions of the usual active substances include, for example, the lower aliphatic alcohols or alkanols, such as methyl alcohol, ethyl alcohol or isopropyl alcohol, optionally mixed with water. The solutions may also contain auxiliary substances, in particular dispersing agents.

For application of the active substances from the solvent-free melt, the substances are heated to 35° C. to 90° C., optionally together with an auxiliary substance.

The cord which functions as carrier may be impregnated either as an endless rope or as piece goods. Securing the ends of the cords against fraying is carried out either before or after impregnation. If they are secured by winding yarn around them or by welding or gluing them, this is preferably done before impregnation but securing the ends of the cords by knotting them is most suitably done after impregnation.

Any excess active substance can be removed by stripping or squeezing the cords. The cords are then dried with hot or cold air or, if the active substances are applied from a solvent-free melt, they are left to solidify at room temperature or in a stream of cold air. If the conditioner device is also to contain a perfume, this is applied together with the active substances from the solution or dispersion. If the active substance is to be applied from a solvent-free melt, the perfume, if used, should be applied in a separate operation.

The invention also relates to a process for the treatment of laundry in a drier. In this process the device according to the invention is introduced into the drier together with the moist laundry and left to act on the laundry during the process of drying. By virtue of its slight weight and its shape, the device comes into intimate and repeated contact with the pieces of laundry so that the active substances, which are softened or liquefied at the temperatures in the drier, are transferred uniformly to the pieces of laundry.

The invention will now be described in more detail with the aid of the following examples, which are not to be considered limitative in any manner.

EXAMPLE 1

This example describes the manufacture of a device according to the invention intended for a standard domestic drier and its action on freshly washed laundry.

A twisted cable of polyacrylonitrile approximately 1 cm in diameter and approximately 30 cm in length and weighing 2.3 gm was dipped for approximately 10 seconds into a solution of 36% by weight of ditallow alkyl-dimethylammonium chloride, 40% by weight of water, 20% by weight of isopropyl alcohol and 4% by weight of perfume oil. Excess solution was removed on a laboratory foulard and both ends were secured against fraying by tying a knot and the cord was dried in air at 90° C. It weighed 5.0 gm after drying and had taken up 2.7 gm of active substance.

The perfume oil employed was a fragrance which can be described as "flowery fancy lavender with a radiant fresh headnote" and had the following composition:

| | Percent by Weight |
|---|---|
| Lavender oil 40/42% | 350 |
| Lavendin oil 30/32% | 280 |
| Italian lemon oil | 100 |
| Rosmary oil | 80 |
| Geranium oil | 50 |
| Terpineol (perfumery) | 50 |
| α-Hexyl cinnamaldehyde | 50 |
| Patchouli oil Karimun | 20 |
| Ketone musk | 20 |

Freshly washed laundry (2.8 kg dry weight, ⅓ Turkish towelling, ⅔ smooth cotton fabric) and a few strips of polyester/cotton 65:35 were dried (program "extra dry") in a commercial moisture-controlled domestic drier in the presence of the cable described above.

The perfume, handle and electrostatic properties of the laundry were then determined. The electrostatic properties were tested on the test strips, using a static voltmeter R 1020 manufactured by Rothschild, Zurich, Switzerland.

Pieces of laundry which had been treated with the device according to the invention were found to have a marked improvement in handle and to be pleasantly scented. The anti-electrostatic effect is also demonstrated by a significantly more rapid decrease in the static charge.

EXAMPLE 2

The substrate in the form of the cord described in Example 1 was impregnated by a method similar to that of Example 1 with a solution consisting of 25% by weight of ditallow alkyl-dimethylammonium chloride, 15% by weight of the condensation product of one mol of hardened tallow and one mol of hydroxyethyl-ethylenediamine, 5% by weight of a coconut alcohol polyethylene glycol ether (degree of ethoxylation 4), 15% by weight of isopropyl alcohol and 4% by weight of perfume oil, remainder water, and the cord was then further treated as described in Example 1.

When this product was used in a drier, the properties of the fabrics were again found to be markedly improved.

EXAMPLE 3

A braided cotton cord, the ends of which were secured against fraying by plaiting, was impregnated by immersion into a mixture, which had been melted at 80° C., of 50% by weight of ditallow alkyl-dimethylammonium chloride in the form of a 75% paste (remainder isopropyl alcohol) and 50% by weight of a condensation product of one mol of hardened tallow and one mol of hydroxyethyl-ethylenediamine, and the cord was then cooled by a blast of cold air.

It weighed 1.9 gm without active substance and 5.3 gm after impregnation and drying. 3.4 gm of active substance were applied to the carrier.

In a separate operation, the cord was sprayed with 0.5 gm of perfume oil so that it finally weighed 5.8 gm.

Laundry treated with this product in the drier was also found to have a distinctly improved handle and pleasant scent and its electric charge dropped more rapidly.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A laundry finishing treatment rope for use in a mechanical laundry drier comprising an entwined strand of textile fibers in a cord form having a diameter of from 0.3 to 2.5 cm and a length of from 10 to 50 cm, sufficient to make uniform contact with the moving articles of laundry when used in a mechanical laundry drier, and having both ends secured against fraying, said rope being impregnated with an amount of from 10% to 90% by weight of the weight of said rope, sufficient for conditioning one loading of a mechanical laundry drier, of a substance of the laundry finishing treatment type effective in a mechanical laundry drier.

2. The laundry finishing treatment rope of claim 1 wherein the entwined strand of textile fibers in a cord form is a braided cable.

3. The laundry finishing treatment rope of claim 1 wherein the entwined strand of textile fibers in a cord form is a hollow knitted braid.

4. The laundry finishing treatment rope of claim 1 wherein the entwined strand of textile fibers in a cord form is a warp-knitted braid.

5. The laundry finishing treatment rope of claim 1 wherein said effective substance is present in an amount of from 20% to 80% by weight of the weight of said rope.

6. The laundry finishing treatment rope of claim 1 wherein said rope has a diameter of from 0.5 to 1.5 cm and a length of from 20 to 40 cm.

7. The laundry finishing treatment rope of claim 1 wherein the textile fibers are synthetic fibers selected from the group consisting of polyacrylonitrile fibers, polyester fibers and polyamide fibers.

8. The laundry finishing treatment rope of claim 1 wherein the textile fibers are natural fibers selected from the group consisting of cotton fibers, wool fibers, hemp fibers and flax fibers.

9. The laundry finishing treatment rope of claim 1 wherein the textile fibers are dyed.

10. The laundry finishing treatment rope of claim 1 wherein said substance of the laundry finishing treatment type is selected from the group consisting of fabric softeners and antistatic agents for fibers.

11. The laundry finishing treatment rope of claim 1 wherein said substance of the laundry finishing treatment type is selected from the group consisting of fabric softeners, antistatic agents for fabrics, antimicrobial agents, soil release substances, ironing aids, flame-retarding substances, mothproofing agents and mixtures thereof.

12. The laundry finishing treatment rope of claim 1 wherein the entwined strand of textile fibers in a cord form is a twisted cable.

13. The laundry finishing treatment rope of claim 12 wherein the ends are secured against fraying by knots.

14. The laundry finishing treatment rope of claim 12 wherein the ends are secured against fraying by yarn wound around the ends.

15. The laundry finishing treatment rope of claim 12 wherein the ends are secured against fraying by gluing.

16. The laundry finishing treatment rope of claim 12 wherein the textile fibers are synthetic fibers and the ends are secured against fraying by welding.

17. A laundry finishing treatment rope for use in a mechanical laundry drier comprising an entwined strand of textile fibers in a cord form having a diameter of from 0.3 to 2.5 cm and a length of from 10 to 50 cm, sufficient to make uniform contact with the moving articles of laundry when used in a mechanical laundry drier, and having both ends secured against fraying, said rope being impregnated with an amount of from 10% to 90% by weight of the weight of said rope, sufficient for conditioning one loading of a mechanical laundry drier, of a substance of the laundry finishing treatment type effective in a mechanical laundry drier, wherein said substance is selected from the group consisting of:

(1) a quaternary ammonium compound having two $C_{16}$–$C_{20}$ alkyl groups or alkenyl groups and two methyl groups in the molecule and a chloride, bromide or methyl sulfate anion, alone, and (2) a mixture of said quaternary ammonium compound with the condensation product of one mol of hardened tallow and one mol of hydroxyethylethylenediamine in proportions of from 4:1 to 1:4.

18. The laundry finishing treatment rope of claim 17 wherein said quaternary ammonium compound is ditallow alkyl-dimethylammonium chloride.

19. In the process for after-treating laundry in a mechanical drier comprising tumble drying moist laundry in a mechanical drier in the presence of a laundry finishing treatment agent which acts on the laundry during the drying process and recovering dry after-treated laundry, the improvement consisting of using the laundry finishing treatment rope of claim 1, as said laundry finishing treatment agent.

* * * * *